US006129349A

United States Patent [19]

Olbrich et al.

[11] Patent Number: 6,129,349

[45] Date of Patent: Oct. 10, 2000

[54] REVERSING MECHANISM FOR SHEET-LIKE ITEMS

[75] Inventors: Otto Olbrich, Taufkirchen; Reinhold Rigauer, Erding; Otto Rotheimer, Munich; Rudolf Seeberger, Lochham; Joseph Dietl, Unterhaching; Georg Boehmer, Munich; Bernward Heller, Kirchheim; Hubert Mugrauer, Zorneding; Hans Hahn, Unterhaching; Richard Pardubitzki, Munich, all of Germany

[73] Assignee: Oce Printing Systems GmbH, Poing, Germany

[21] Appl. No.: 09/284,921

[22] PCT Filed: Oct. 20, 1997

[86] PCT No.: PCT/DE97/02431

§ 371 Date: Aug. 18, 1999

§ 102(e) Date: Aug. 18, 1999

[87] PCT Pub. No.: WO98/17570

PCT Pub. Date: Apr. 30, 1998

[30] Foreign Application Priority Data

Oct. 22, 1996 [DE] Germany ..... 196 43 666

[51] Int. Cl.[7] ..... B65H 29/00

[52] U.S. Cl. ..... 271/186; 271/902; 271/303

[58] Field of Search ..... 271/186, 902, 271/303, 176

[56] References Cited

U.S. PATENT DOCUMENTS

| | | | |
|---|---|---|---|
| 4,842,263 | 6/1989 | Robertson | 271/186 |
| 4,921,236 | 5/1990 | Saeki et al. . | |
| 5,014,976 | 5/1991 | Muck et al. . | |
| 5,123,761 | 6/1992 | Rosenthal | 271/303 |
| 5,303,017 | 4/1994 | Smith | 271/186 |
| 5,415,391 | 5/1995 | Wong et al. . | |
| 5,449,164 | 9/1995 | Quesnel et al. | 271/186 |
| 5,629,762 | 5/1997 | Mahoney et al. | 271/186 |

FOREIGN PATENT DOCUMENTS

| | | | |
|---|---|---|---|
| 37 27 555 A1 | 8/1987 | Germany . | |
| 88 03 496 | 3/1988 | Germany . | |
| 39 14 183 A1 | 4/1989 | Germany . | |
| 59-022848 | 6/1984 | Japan . | |
| 0057437 | 3/1988 | Japan | 271/186 |
| 405310356 | 11/1993 | Japan | 271/186 |

OTHER PUBLICATIONS

Patent Abstracts of Japan Application No. 61–132578 filed Jun. 6, 1986.

Patent Abstracts of Japan Application No. 58346373 filed Dec. 27, 1983.

*Primary Examiner*—H. Grant Skaggs
*Attorney, Agent, or Firm*—Hill & Simpson

[57] ABSTRACT

An active switching mechanism is used for diverting paper sheets from a first area (A) to either possible paths (ab or ac). The sheets along the first path (ab) can be directly conveyed to a second area (B), and the sheets along the second path (ac) can be directed through a passive switching mechanism (4) to a third area (C), the direction of the moving sheets being reversed through a reversing mechanism, thereby enabling said sheets to be conveyed in the reverse direction from the third area (C) along a third path (cb) to the second area (B), using a passive switching device (4).

19 Claims, 5 Drawing Sheets

REVERSING MECHANISM FOR SHEET-LIKE ITEMS

FIELD OF THE INVENTION

The present invention is directed to a turn-over apparatus in a guide system for sheets of sheet-shaped material, particularly for individual sheets of paper in a single-sheet printer comprising a paper guide system, whereby the guide system contains shunt elements that make it possible to deliver the sheets to a unit for further processing with the one or the other of its sides facing up as needed. The invention is also directed to a passive shunt unit.

BACKGROUND OF THE INVENTION

Patents Abstracts of Japan M-701 together with JP 62-290 668 A discloses a sheet transport means that has three areas that are connected by transport paths. An active shunt unit at the passive shunt unit make it possible that individual sheets, coming from a first area, are supplied to a third area even directly without being turned over or with the passive shunt unit while being turned over. A similar arrangement is also disclosed by DE 37 27 555 A1.

DE 88 03 496 U1 discloses a printer with a plurality of output channels for recording media. Single sheets are conveyed via deflection elements in the printer. Extruded profiles are arranged close to conveyor drums and have their contours lying relatively close at these drums.

DE 39 14 183 A1 also discloses a conveyor means for sheets of paper, whereby shunt arrangements are employed. The conveyor path is formed by extruded profiles that are arranged close to conveying drums and correspond to their contours.

U.S. Pat. No. 5,014,976 discloses a conveyor device for paper in a copier. The guide element with displaceable curvatures is known in the conveying path for single sheets. The single sheets are guided along these curvatures. The invention is based on the object of offering a reliably working turn-over means and a passive shunt unit with simple structure.

SUMMARY OF THE INVENTION

In order to overcome the disadvantages of the prior art, the present invention provides a triangle-like arrangement composed of a first area or, respectively, source area, of a second area or, respectively, destination area and of a third area or, respectively, turn-over area in which the conveying direction is reversed. In the destination area, one either obtains sheets whose one side points up in that they are supplied directly to the destination area from the source area or, on the other hand, receives sheets whose other side points up in that they are supplied to the destination area from the source area indirectly via the reversing region whereat its conveying direction is reversed. The combination of the triangle arrangement formed by the three areas with the reversing of the conveying direction occurring in the reversing region thus enables the sheets to be turned over. The invention only needs a few moving parts, is therefore simply constructed and can be manufactured with little outlay.

The active shunt unit comprises a driven deflection element that redirects the sheets transported in from the source area into the first path or into the second path depending upon its drive. The entire turn-over process of a sheet is thus achieved by a single, small moveable deflection element, as a result whereof the risk of a paper jam in the turn-over means is greatly reduced.

The passive shunt unit only allows sheets to pass either along the second path from the source area to the diversing area or along the third path from the reversing area to the destination area. What is thereby assured is that the sheets—dependent on the position of the active shunt unit—have only two possibilities for traversing the turn-over means namely directly from the source area to the destination area or indirectly from the source area via the reversing area to the destination, whereby the one or the other side of the sheets faces respectively up in the destination area.

Advantageously, the reversing unit is composed of a pair of oppositely driven drums with a draw-in region between the drums and of a position detector for acquiring the draw-in position of the sheets, whereby the drum pair can be operated in two directions for drawing the sheets in and for ejecting the sheets in the reverse direction. The position detector, for example in the form of a light barrier, thereby detects when the trailing end of the sheet has past completely through the passive shunt unit. Only then can the transport of the sheets in forward direction be stopped and the conveying direction be reversed, whereby the passive shunt unit—due to its special form—is traversed differently by the sheet in the following transport then during transport of the sheet in forward direction.

In an especially advantageous development of the turn-over apparatus, the various paths as well as the active and the passive shunt unit are fixed by extruded profiles lying opposite one another in pairs that are secured between two plates arranged parallel. As a result thereof, an especially compact and stable structure is achieved, since the connection of the extruded profiles defining the paths to the parallel plates performs a significant contribution to the static stability of the overall device structure.

It is especially advantageous when respectively one of the extruded profiles lying opposite one another in pairs is arranged pivotable around a rotational axis proceeding perpendicular to the conveying direction of the sheets and in the plane of the sheets and can be locked between the two plates arranged parallel in the position defining the respective path. This swivelability of some of the extruded profiles of the turn-over means enables a fast and simple access to all areas of the paper paths and of the shunt units in case of a paper jam.

In a specific development of a turn-over apparatus, a roller pair for the transport of the sheets together with a position detector allocated to the respective roller pair for acquiring the position of the sheets is arranged in each of the three areas, whereby the path length along the various paths between the respective roller pairs of the three regions is short then the length of the sheets to be conveyed. What is thereby assured is that a sheet to be conveyed through the paths is always located between of the drum pairs of the three areas and its continued transport is assured.

A development of the turn-over apparatus is especially expedient wherein the contours of the extruded profiles in the three areas lie closely adjacent to the contours of the respective drums. The risk of a paper jam in the region of the roller pairs is thereby minimized in the transition from a channel end to the next channel start of a path.

In another advantageous development, the contours of the extruded profiles and of the drums partly overlap, and projections of the extruded profiles engage into depressions of the drums and/or projections of the drums engage into depressions of the extruded profiles. As a result of this extremely close approach of the drums to the extruded profiles, the "handover" of the sheets from the channels to the transport drums and vice versa from the transport drums to the channels involves only an extremely slight risk of a paper jam.

In a preferred development of the turn-over apparatus, the deflection element of the active shunt unit is fashioned essentially wedge-shaped, whereby the tapering decision edge of the wedge is directed toward the path for the sheets conveyed to the turn-over apparatus, and the base region of the wedge is arranged pivotable between a first position and a second position around a rotational axis that proceeds perpendicular to the conveying direction of the sheets and parallel to the plane of the sheets, whereby the base of the wedge perpendicular to the rotational axis of the wedge shields the region between the entry areas into the two paths for the sheets transported to the destination region or, respectively, to the reversing region, and the sheets are steered into the one or into the other path dependent on the position of the deflection element along the wedge surface. As a result of this design of the active or, respectively, dynamic shunt unit, an efficient and dependable shunt function is achieved with a low risk of a paper jam. As a result of the wedge-shaped fashioning of the deflection element, moreover, the dynamic forces occurring during movement of the deflection element are especially low, as a result whereof, for example, a high switching frequency can be realized for the deflection element.

Inventively, the passive shunt unit has a stationary wedge with a decision edge, whereby the tapering wedge is bent away from a path cb with respect to the angle bisector of the angle formed by the tangents at the two paths ac and cb in the region of the passive shunt unit. This specific shaping of the passive or, respectively, static shunt unit makes it possible that, given paper delivery from the active or, respectively, dynamic shunt unit along the path ac, the paper passes through the bellied part of this path curved on its way to the reversing region. After the reversal of the conveying direction of the paper sheet, the paper reverses this curvature of its trailing edge caused by the belly in the path ac due to its stiffness, so that, following the reversal in direction, it no longer passes through the passive shunt unit toward the path ac but in the direction of the path cb because of the wedge that is always bent away from the path cb.

It is especially advantageous when the extruded profile of the path ac is bellied outward in the region lying opposite the wedge that is bent away, so that the gap width of the path ac is essentially constant between the extruded profile and the bent-away wedge. As a result thereof, a constriction and, thus, an increased resistance for the sheets in the path ac is avoided.

In an embodiment, the present invention provides a guide system for two-sided sheets of material wherein each sheet includes a first side and a second side. The guide system comprises a first area comprising a first conveying mechanism for propelling one of the sheets of material towards an active shunt. The active shunt is disposed between the first area and two possible paths which include a first path leading to a second area and a second path leading to a third area. The active shunt is pivotable between a first position and a second position. In the first position, the sheet of material is directed along the first path and the second path is blocked. In the second position, the sheet of material is directed along the second path and the first path is blocked. The active shunt is disposed between the first area and a passive shunt. The passive shunt is disposed between the active shunt and the third area and the passive shunt is also disposed between the third area and the second area. The passive shunt comprises a tapering wedge disposed between the second path and a third path that leads from the third area to the second area. The third area comprises a second conveying mechanism. The second conveying mechanism is reversible wherein the second conveying mechanism draws the sheet into the third area as the sheet passes through the second path and past the tapering wedge and the second conveying mechanism reverses direction to propel the sheet past the tapering wedge along the third path and towards the second area. The tapering wedge extends away from the third path and towards the second path thereby blocking the sheet from entering the second path after it has been drawn into the third area by the second conveying mechanism. The second path extends around the tapering wedge in an S-shaped fashion. The first path delivers the sheet to the second area with the first side of the sheet oriented for printing. In contrast, the third path delivers the sheet to the second area with the second side of the sheet oriented for printing. Therefore, the routing of a sheet through the second path and third path to the second area effectively flips the sheet over or turns the sheet over as compared to directly routing the sheet to the second area on the first path.

In an embodiment, the second path has a width that remains constant as the second path extends around the tapering wedge.

In an embodiment, the second conveying mechanism comprises a pair of oppositely driven drums having a draw-in area between the drums and a position detector disposed between the tapering wedge and the drums for detecting a trailing edge of the sheet as it passes the position detector. The pair of drums are operable in two directions for drawing the sheet into the third area and for ejecting the sheet along the third path towards the second area.

In an embodiment, the first path is defined by the passive shunt and a first profile, the second path is defined by the passive shunt and a second profile and the third path is defined by the passive shunt and a third profile.

In an embodiment, the first, second and third profiles are pivotable about first, second and third axes respectively that are disposed perpendicular to the first, second or third paths respectively.

In an embodiment, the second area comprises a third conveying device, the first conveying device being spaced from the third conveying device by a first distance that is shorter than the sheet, the first conveying device being spaced from the second conveying device by a second distance that is shorter than the sheet and the second conveying device being spaced from the third conveying device by a third distance that is shorter than the sheet.

In an embodiment, the second conveying mechanism comprises a pair of oppositely driven drums, each drum comprising at least one recess. The first path is defined by the passive shunt and a first profile and the second path is defined by the passive shunt and a second profile and the third path is defined by the passive shunt and a third profile. The second profile extends into the recess of one of the drums and the third profile extends into the recess of the other drum.

In an embodiment, the active shunt comprises a wedge comprising a tapering decision edge that faces the first area and a base pivotable about a rotational axis perpendicular to the first and second paths and parallel to the plane of the sheet.

Other objects and advantages of the present invention will become apparent from reading the following detailed description and appended claims, and upon reference to the accompanying drawings.

BRIEF DESCRIPTION OF THE DRAWINGS

Further advantages, features and possible uses of the invention derive from the following description of preferred exemplary embodiments with reference to the drawings, wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
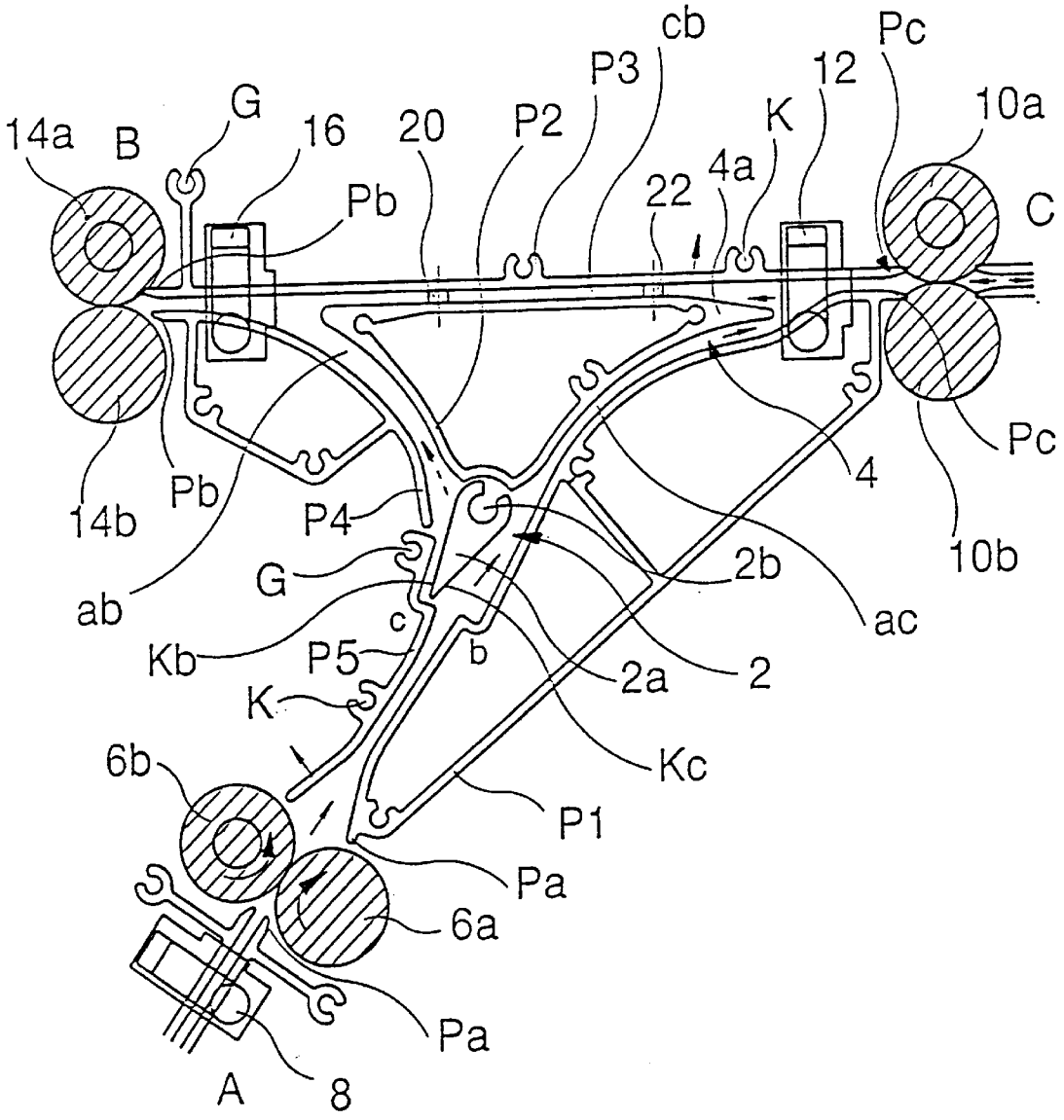
FIG. 1 is a side view of a first embodiment of the inventive turn-over means.

FIG. 1 shows the sectional view of a first embodiment of the inventive turn-over apparatus. The turn-over means contains a combination of profiles P1 through P5 which, for example, are a matter of extruded profiles and that are secured between two plates (not shown) such as, for example, sheet metal plates. The extruded profiles P1 through P5, which contribute to the stability of the apparatus, are rigidly screwed to the lateral plates that, for example, can have a thickness of only 2 mm. Self-tapping screws, for example, can be utilized for the screwed connection. The screwing thereby ensues in openings (not shown) that are already co-formed in the respective extruded profile P1 through P5 for this purpose.

The extruded profiles P3 and P5 are secured rotatable around a respective rotational axis G, so that they can be pivoted out, for example for eliminating a paper jam. To this end, a button K projects outward at the pivotable end, and the user can grasp this and pivot the respective profile. This button K serves the purpose of fastening to a rod (not shown) that is seated in one of the co-formed openings of the respective profile and that is plugged into a bore of the rear lateral plate for positioning the profile. The rotational axis G around which such a moveable profile can be swiveled is likewise seated in such an opening. The pivotable profiles P are electronically monitored, i.e. whether they are open or closed is displayed.

Three areas A, B, and C of the inventive turn-over apparatus are shown in the illustrated embodiment. A source area A contains a drum pair 6*a*, 6*b* and a positioned detector 8. A destination area B likewise contains a drum pair 14*a*, 14*b* and a position detector 16. A reversing area C contains a drum pair 10*a*, 10*b* and a position detector 12. The position detectors 8, 12 and 16 are preferably fashioned as light barriers. The profiles P1 through P5 define conveying paths for the paper, namely a path ac between the area A and the area C, a path ab between the area A and the area B, as well as a path cb between the area C and the area B.

An active or dynamic shunt unit 2 is fashioned in the paths ab and ac. This shunt unit 2 contains a pivotable deflection element 2*a* that, for example, can be electrically or pneumatically driven. The deflection element 2*a* of the active shunt unit 2 is fashioned wedge-shaped, whereby its tapering decision edge is directed toward the path for the sheets transported to the turn-over means. In the region of its base, the wedge-shaped deflection element 2*a* is pivotable between a position b and a position c around a rotational axis 2*a* extending perpendicular to the conveying direction of the sheets and parallel to the plane of the sheets (the deflection element is in position c in the illustrated condition), so that it can steer the transport of the sheets from the source area A to the destination area B or, respectively, to the reversing area C. Dependent on the positions b or c of the wedge-shaped deflection element 2*a*, the sheets thereby slide along the wedge face Kb or, respectively, kc thereof into the path ab or, respectively, ac.

A passive or, respectively, static shunt unit 4 is also arranged in the paths ac and cb preceding the reversing area C. Given this passive shunt unit 4, a stationary, tapering wedge 4*a* having a decision edge at which a decision about the direction in which the sheets will continue to be conveyed is arranged such that a sheet deriving from the area A is conveyed over the path ac to the reversing area C, whereas a sheet deriving from the reversing area C can only be conveyed into the path cb to the destination area B. This is possible since the tapering wedge is bent away from the path cb with respect to the angle bisector W of the two tangents T1, T2 (see FIG. 4) at the two paths ac and cb in the shunt region. Further, the profile P1 of the path ac is convexly arced in the region of the bent-away wedge foray, so that the gap width s of the path ac is not constricted and increased resistance for the sheets to be conveyed does not arise.

Whereas the source area A with its drum pair 6*a*, 6*a* as well as the destination area B with its drum pair 14*a*, 14*b* serve the purpose of further-transport of the sheets, the reversing area C has the job of drawing a sheet introduced over the path ac in, moving it farther between the drum pair 10*a*, 10*b* until the trailing edge of the sheet has passed by a position detector 12, whereupon the rotational motion of the drum pair 10*a*, 10*b* is stopped and reversed, so that the sheet is moved through the passive shunt unit 4 in the opposite direction, whereby, however, it is no longer conveyed back into the path ac this time but is conveyed to the destination area B in the path cb.

Two operating instances can be distinguished dependent on the position of the deflection element 2*a* in the active shunt unit 2. When the deflection element is in the position b, then the paper deriving from the source area A is directly conveyed into the destination area B. When, by contrast, the deflection element 2*a* of the active shunt unit 2 is in the position c, then the paper is initially conveyed over the path ac through passive shunt unit 4 into the reversing area C, wherein it is initially pulled in toward the right in order to then be in turn ejected in the opposite direction. Due to the specific shaping of the paper channel, the paper sheet ejected in the opposite direction now moves into the path cb and, ultimately, to the destination area B. The two operating instances defined by the position of the deflection element 2*a* of the active shunt unit 2 respectively convey a sheet to the destination area B with either the one or the other of its sides facing up, i.e. with its front side or with its back side facing up. From the destination area B, the sheets that have been turned over or not turned over can then be supplied to a post-processing unit.

In the illustrated turn-over apparatus, the profiles P1, P4 are firmly screwed in, whereas the profiles P2, P3, P5 are pivotable, whereby the profiles P2 and P3 are rigidly connected to one another by webs 20, 22 outside the path cb and can thus only be pivoted out in common. The pivot motion thereby respectively ensues around the rotational axis of the profiles that is referenced G. The natural metallic surface has been intentionally retained in all profiles employed, i.e., in particular, no anodizing is implemented, so that the electrostatic charge potentially arising due to the paper motion can be easily eliminated. All profiles have their contours Pa, Pb, Pc brought as close as possible to the corresponding drum pairs 6*a*, 6*b*, 14*a*, 14*b* or, respectively, 10*a*, 10*b* of the areas A, B or, respectively, C. As a result thereof, the paper is reliably introduced into the respective drum pairs from the channel end of the paths, as a result whereof a paper jam is avoided in the area of the drum pairs. In the reversing area C, the contours Pc of the profiles P1, P3 can even be brought so close to the drums 10*a*, 10*b* that the contours Pc of the profiles P1, P3 and of the drums 10*a*, 10*a* partly overlap. The profiles P1, P3, however, thereby only engage into the drum contour at certain locations, whereby the drum diameter is reduced at these locations.

Figure 2:
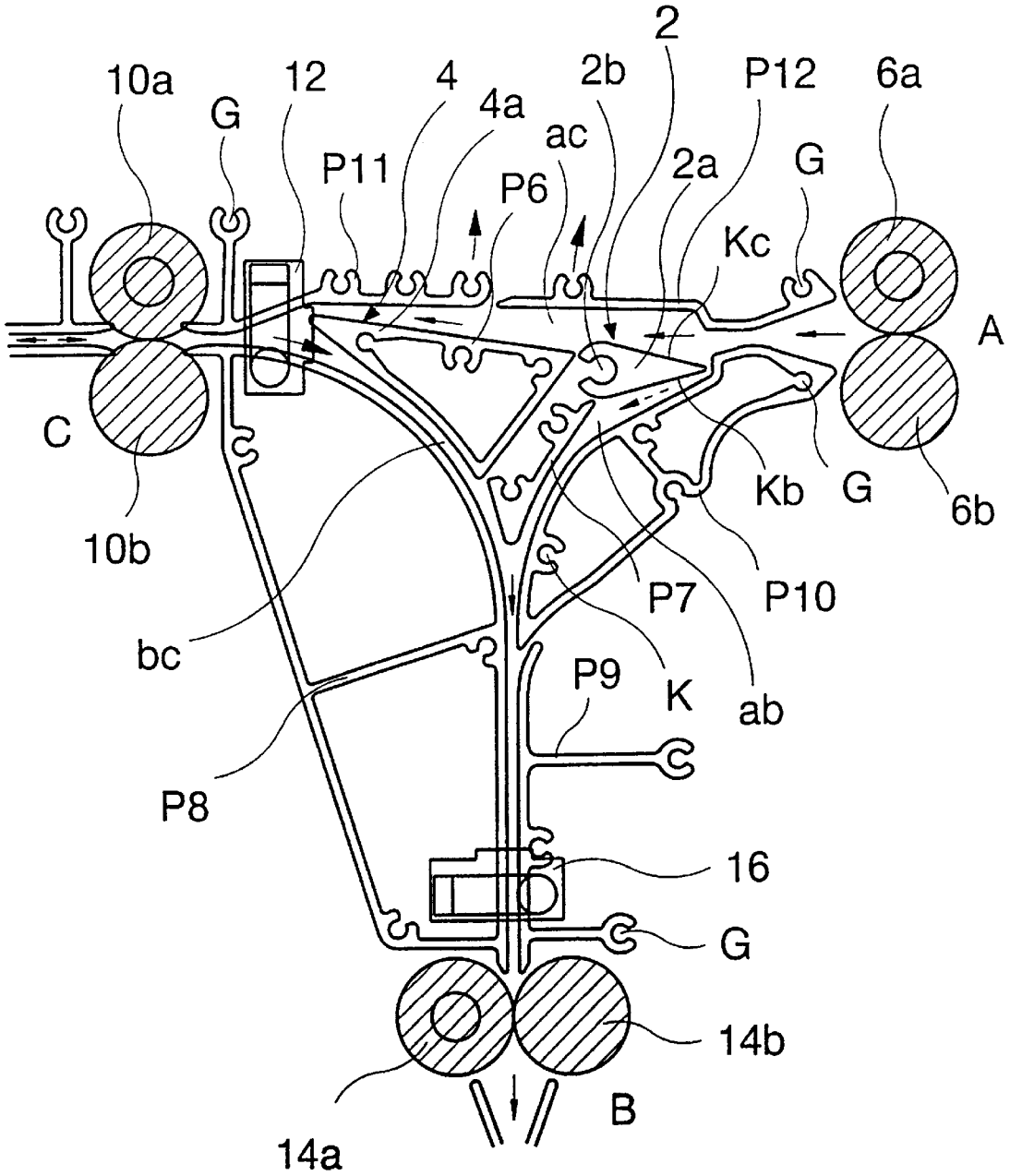
FIG. 2 is a sectional view of a second embodiment of the inventive turn-over means.

FIG. 2 shows a sectional view of a second embodiment of the inventive turn-over apparatus. The turn-over means contains a combination of profiles P6 through P12. Elements that correspond to those of FIG. 1 have the same reference characters. Here, too, paper that is turned over or not turned over is supplied to the destination area B dependent on the position of the deflection element 2*a*. In another application, the paper can also be introduced from the area C. In this case, it automatically follows the path through the area B due to the passive shunt unit 4. The profiles P7 and P8 are fixed in this embodiment. The other profiles P6, P9, P10, P11 and P12 are pivotable around their respective rotational axis G, whereby the profile P6 is rigidly connected to the profile P11, i.e. pivots in common with this.

Figure 3:
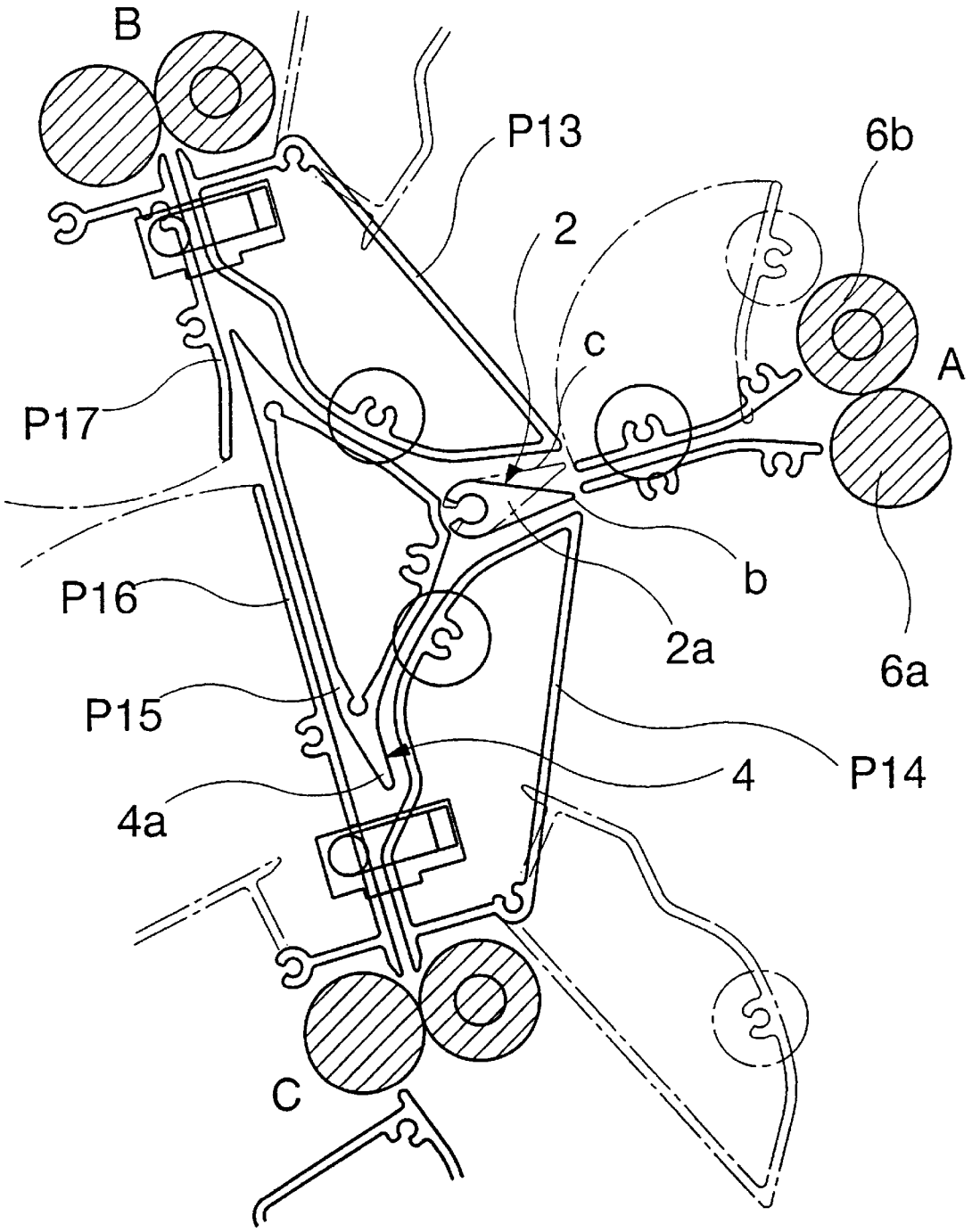
FIG. 3 is a sectional view for illustrating the functioning of a first element of the inventive turn-over means.

FIG. 3 shows a more detailed sectional view of the inventive dynamic shunt unit 2 with profiles P13 through P17. The deflection element 2*a* pivotable around the rotational axis 2*b* is shown in the two positions b and c, whereby the deflection element 2*a* in the position b is shown with a solid line and is shown with a dot-dashed line in the position c. When the deflection element 2*a* is in the position b, then a sheet deriving from the area A is deflected to the region B. When, by contrast, the deflection element 2*a* is in the position c, then the sheet deriving from the area A is conveyed to the area C. The arrangement shown in FIG. 3 is a matter of an exclusive shunt arrangement since it has no reversing area necessary for the turn-over function. Both the area B as well as the area C serve here for further-transport of the sheets. The dot-dashed lines show some of the profiles, for example the profiles P13, P14 and P16, in their pivoted-out condition.

Figure 4:
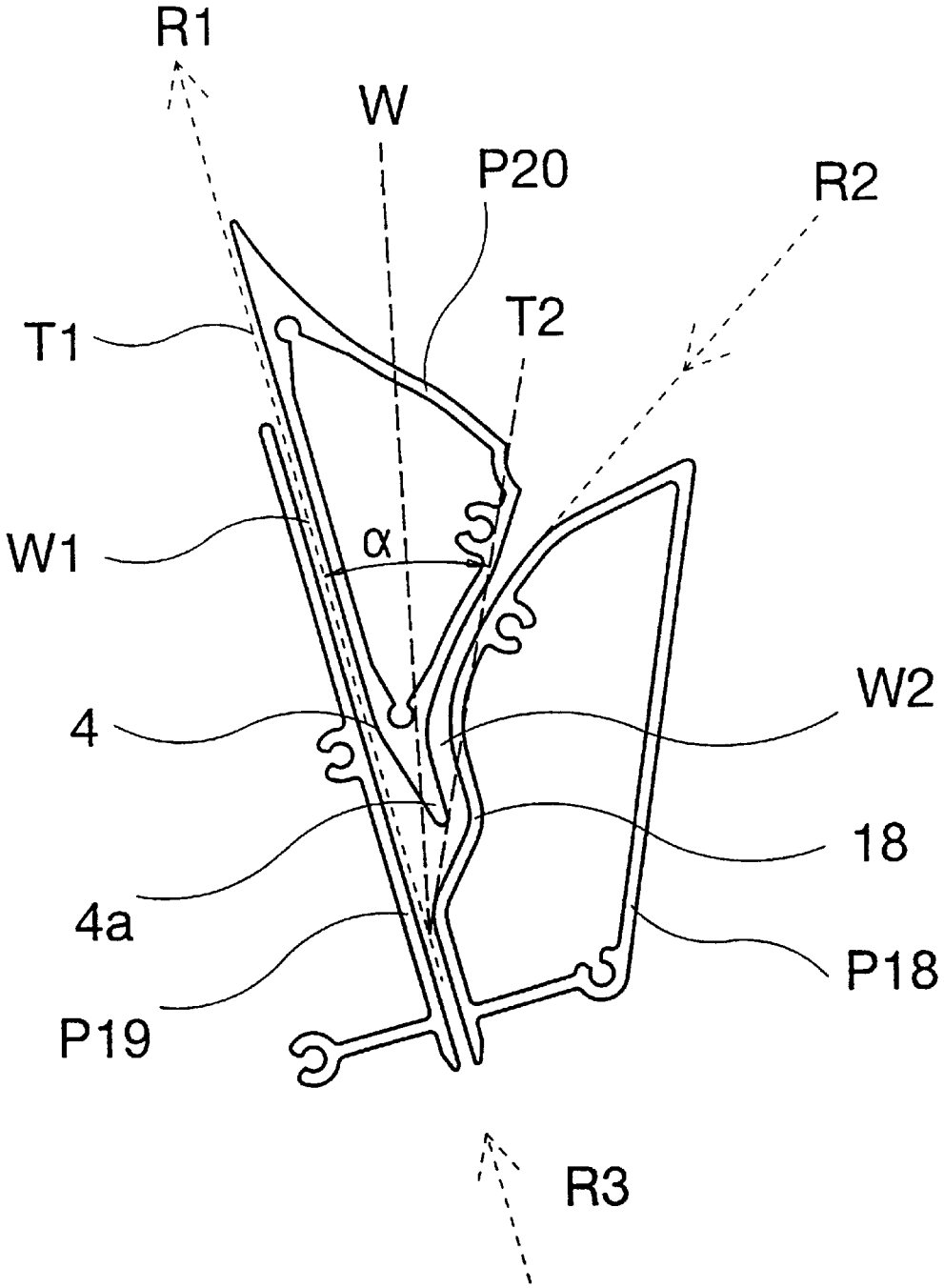
FIG. 4 is a sectional view for illustrating the functioning of a second element of the inventive turn-over means.

FIG. 4 shows a more detailed sectional view of the inventive, passive shunt unit 4. The passive shunt unit 4 is formed by three profiles P18, P19 and P20. Respectively together with the profile P20, the profile P18 and the profile P19 form a path w1 or, respectively, w2 extending toward the top at the left and extending toward the top at the right. The tapering wedge 4*a* is rigidly connected to the profile P3, whereby the tapering decision edge of the wedge 4*a* is essentially directed toward the path coming from below. The tangent T1 along the path upwardly directed toward the left and the tangent T2 along the path upwardly directed toward the right erect an angle with an angle bisector W. The tapering wedge 4*a* of the passive shunt unit 4 is curved away from the direction of the angle bisector W.

As a result of this specific shaping of the passive shunt unit 4, a sheet of paper has two possibilities of traversing the shunt unit 4. A sheet introduced from below along the arrow R3 passes the shunt unit 4 along the path directed toward the top left, this being indicated by the arrow R1. Due to the stiffness of the paper, it is impossible that the leading paper end of the sheet introduced from below proceeds in the shunt unit 4 into the path directed toward the top right. The path directed toward the top right can only be traversed by a paper that is introduced over this path from the top right along the arrow R2. Due to its flexibility, the sheet of paper introduced from the top right can unproblemmatically pass the S-shaped area of this path opposite the wedge 4*a* bent away from the angle bisector W with the bellied-out portion 18. When the paper sheet introduced from the top right is to be supplied to a reversing unit in the region below the shunt unit 4, then the paper now moving oppositely upward no longer returns into the channel directed toward the top right from which it previously came but moves along the channel directed toward the top left in the direction of the arrow R1. Here, too, the stiffness and resiliency of the paper is utilized, this aligning again essentially on a straight line when it is transported toward the top left after its reverse indirection after being bent by the S-shaped region during the downwardly directed motion.

Figure 5:
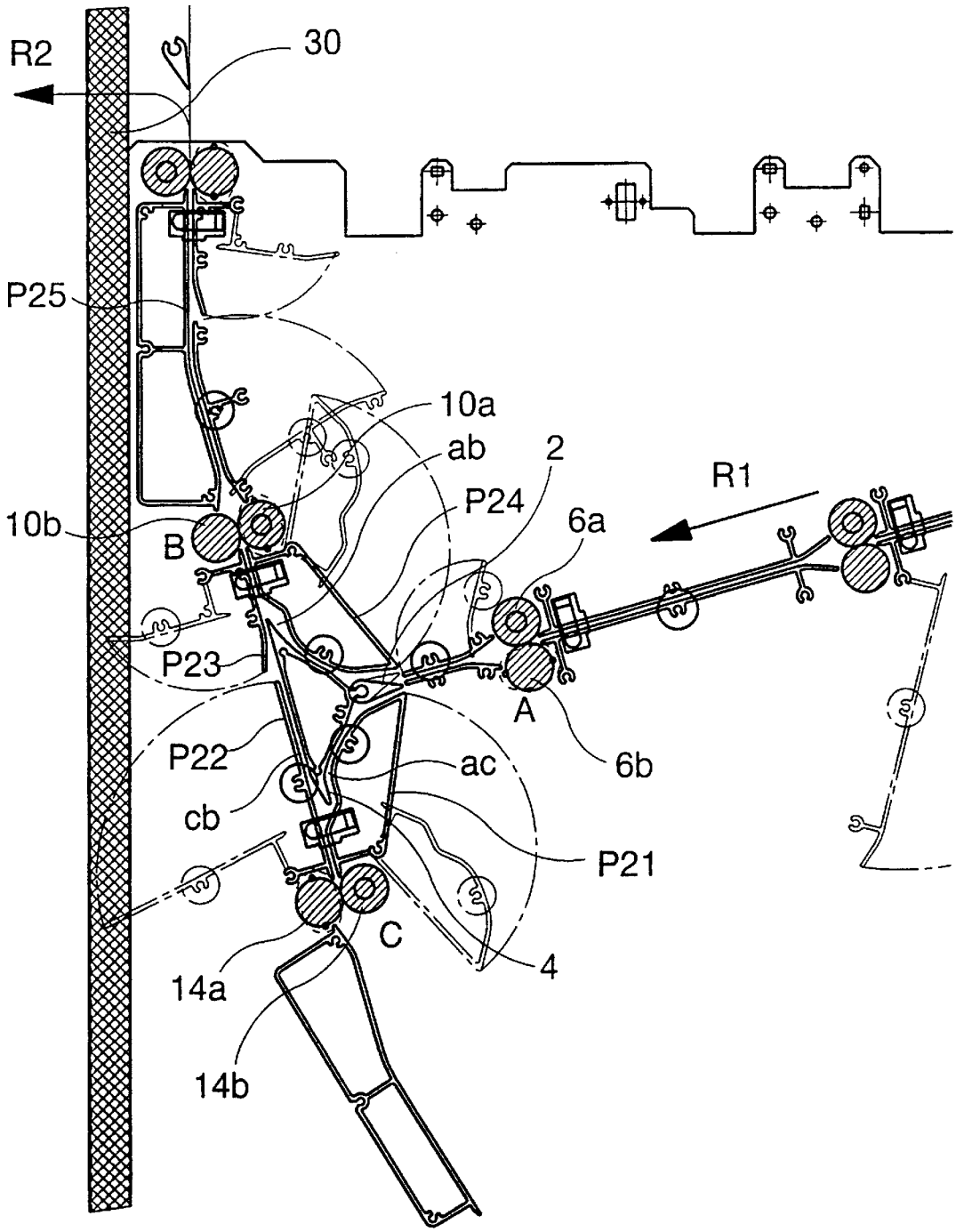
FIG. 5 is a sectional view of the inventive turn-over means installed in a device.

FIG. 5 shows a sectional view of the inventive turn-over arrangement installed in an apparatus with housing 30, this turn-over arrangement containing the profiles P21 through P25. The apparatus, for example, is a matter of an electrophotographic printer. The installed turn-over means enables a paper output either with the image side facing up or with the image side facing down. To this end, the paper is first brought to the inventive turn-over arrangement through a channel along the arrow R1. The paper then passes through the area A and, dependent on the position of the active shunt unit 2, is conveyed along the path ab to the area B, from which it is supplied to, for example, a post-processing unit along the arrow R2. The image side of the single sheet, for example, is thereby directed up.

When the active shunt unit 2 is switched into its other position, then the sheet introduced along the arrow R1 via the area A is diverted toward the left, traverses the path ac and the passive shunt unit 4 in order to ultimately proceed to the area C, where it is initially drawn in and then in turn ejected and finally conveyed to the area B along the path cb. The image side of the sheet of paper is now directed down, so that the paper is supplied to the post-processing unit in its turned-over condition.

All path lengths along the path elements between successive drum pairs must be shorter given the inventive arrangements then the length of the paper sheets to be transported, namely as seen in conveying direction. Each drum pair has a position detector allocated to it, for example in the form of a light barrier, so that where a sheet of paper is located can always be monitored. This makes a corresponding display possible for the user, who, when a paper jam occurs, can then open the paper path at the corresponding location by pivoting a profile down in order to eliminate the paper jam. Profiles P that have been pivoted out are shown dot-dashed in FIG. 5.

LIST OF REFERENCE CHARACTERS

P1–P25 Profiles
G Rotational axis
A First area or source area
B Second area or destination area
C Third area or reversing area
ab First path ac Second path
cb, bc Third path
6*a*, 6*b* Drum pair
10*a*, 10*b* Drum pair
14*a*, 14*b* Drum pair
8, 12, 16 Position detector
2 Active or dynamic shunt unit
2*a* Deflection element
2*b* Rotational axis
4 Passive or static shunt unit
4*a* Tapering wedge
Kb, Kc Wedge face
20, 22 Webs
Pa, Pb, Pc Contours
b First position
c Second position
T1, T2 Tangent
R1, R2, R3 Arrow
18 Bellied-out portion
30 Housing From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A guide system for two-sided sheets of material, each sheet including a first side and a second side, the guide system comprising:

a first area comprising a first conveying mechanism for propelling one of the sheets of material towards an active shunt, the active shunt being disposed between the first area and two possible paths including a first path leading to a second area and a second path leading to a third area, the active shunt being pivotable between a first position and a second position wherein, in the first position, the sheet of material is directed along the first path and the second path is blocked, and, in the second position, the sheet of material is directed along the second path and the first path is blocked, the active shunt also being disposed between the first area and a passive shunt, the passive shunt being disposed between the active shunt and the third area, the passive shunt also being disposed between the third area and the second area, the passive shunt also comprising a tapering wedge disposed between the second path and a third path leading from the third area to the second area, the third area comprising a second conveying mechanism, the second conveying mechanism being reversible wherein the second conveying mechanism drawing the sheet into the third area as the sheet passes through the second path and past the tapering wedge and the second conveying mechanism reversing directions to propel the sheet past the tapering wedge, along the third path and towards the second area, the tapering wedge extending away for the third path and towards the second path thereby blocking the sheet from entering the second path after it has been drawn into the third area by the second conveying mechanism, the second path extending around the tapering wedge in an S-shaped fashion, the first path delivering the sheet to the second area with the first side of the sheet oriented for printing, the third path delivering the sheet to the second area with the second side of the sheet oriented for printing.

2. The system of claim 1 wherein the second path has a width that remains constant as the second path extends around the tapering wedge.

3. The system of claim 1 wherein the second conveying mechanism comprises a pair of oppositely driven drums having a draw-in area between the drums and a position detector disposed between the tapering wedge and the drums for detecting a trailing edge of the sheet as it passes the position detector, the pair of drums being operable in two directions for drawing the sheet into the third area and ejecting the sheet along the third path towards the second area.

4. The system of claim 1 wherein the first path is defined by the passive shunt and a first profile, the second path is defined by the passive shunt and a second profile and the third path is defined by the passive shunt and a third profile.

5. The system of claim 4 wherein the first profile is pivotable about a first axis disposed perpendicular to the first path.

6. The system of claim 4 wherein the second profile is pivotable about a second axis disposed perpendicular to the second path.

7. The system of claim 4 wherein the third profile is pivotable about a third axis disposed perpendicular to the third path.

8. The system of claim 1 wherein the second area comprises a third conveying device, the first conveying device being spaced from the third conveying device by a first distance that is shorter than the sheet, the first conveying device being spaced from the second conveying device by a second distance that is shorter than the sheet, the second conveying device being spaced from the third conveying device by a third distance that is shorter than the sheet.

9. The system of claim 1 wherein the second conveying mechanism comprises a pair of oppositely driven drums, wherein the second path is defined by the passive shunt and a second profile and the third path is defined by the passive shunt and a third profile, and wherein the second and third profiles extend into a recess between the drums.

10. The system of claim 1 wherein the active shunt comprises a wedge comprising a tapering decision edge that faces the first area and a base pivotable about a rotational axis perpendicular to the first and second paths and parallel to a plane of the sheet.

11. A guidance system for a sheets of paper comprising:

a passive shunt comprising a corner section defined by a corner angle and further comprising a tapering wedge that terminates at a decision edge, the passive shunt being disposed adjacent to a first profile wherein the passive shunt and the first profile define a first path, the passive shunt also being disposed adjacent to a second profile wherein the passive shunt and the second profile define a second path, the decision edge extending laterally away from the second path and towards the first path, the first path curving in an S-shaped fashion as the first path extends past the tapering wedge and decision edge.

12. A guide system for two-sided sheets of material, each sheet including a first side and a second side, the guide system comprising:

a first area comprising a first conveying mechanism for propelling one of the sheets of material towards an active shunt, the active shunt being disposed between the first area and two possible paths including a first path leading to a second area and a second path leading to a third area, the active shunt comprising a wedge comprising a tapering decision edge that faces the first area and a base pivotable about a rotational axis perpendicular to the first and second paths, the active shunt being pivotable between a first position and a second position wherein, in the first position, the sheet of material is directed along the first path and the active shunt blocks the second path, and, in the second position, the sheet of material is directed along the second path and the active shunt blocks the first path, the active shunt also being disposed between the first area and a passive shunt, the passive shunt being disposed between the active shunt and the third area, the passive shunt also being disposed between the third area and the second area, the passive shunt also comprising a tapering wedge disposed between the second path and a third path leading from the third area to the second area, the third area comprising a second conveying mechanism, the second conveying mechanism comprises a pair of oppositely driven drums having a draw-in area between the drums and of a position detector disposed between the tapering wedge and the drums for detecting a trailing edge of the sheet as it passes the position detector, the pair of drums being operable in two directions for drawing the sheet into the third area and ejecting the sheet along the third path towards the second area, the tapering wedge extending away for the third path and towards the second path thereby blocking the sheet from entering the second path after it has been drawn into the third area by the second conveying mechanism, the second path extending around the tapering wedge in an S-shaped fashion, the first path delivering the sheet to the second area with the first side of the sheet oriented for printing, the third path delivering the sheet to the second area with the second side of the sheet oriented for printing.

13. The system of claim 12 wherein the second path has a width that remains constant as the second path extends around the tapering wedge.

14. The system of claim 12 wherein the first path is defined by the passive shunt and a first profile, the second path is defined by the passive shunt and a second profile and the third path is defined by the passive shunt and a third profile.

15. The system of claim 14 wherein the first profile is pivotable about a first axis disposed perpendicular to the first path.

16. The system of claim 15 wherein the second profile is pivotable about a second axis disposed perpendicular to the second path.

17. The system of claim 13 wherein the third profile is pivotable about a third axis disposed perpendicular to the third path.

18. The system of claim 12 wherein the second area comprises a third conveying device, the first conveying device being spaced from the third conveying device by a first distance that is shorter than the sheet, the first conveying device being spaced from the second conveying device by a second distance that is shorter than the sheet, the second conveying device being spaced from the third conveying device by a third distance that is shorter than the sheet.

19. The system of claim 12 wherein the drums of the second conveying mechanism defines at least one recess, wherein the first path is defined by the passive shunt and a first profile, the second path is defined by the passive shunt and a second profile and the third path is defined by the passive shunt and a third profile, and wherein the second and third profiles extend into the recess.

* * * * *